United States Patent [19]

Sax et al.

[11] 3,960,313

[45] June 1, 1976

[54] AUTOMATIC SETUP CARTON CONSTRUCTIONS

[75] Inventors: Alan M. Sax, Chicago; Walter J. Stolkin, Schaumburg, both of Ill.

[73] Assignee: Stolmar Corporation, Chicago, Ill.

[22] Filed: Nov. 15, 1974

[21] Appl. No.: 523,996

[52] U.S. Cl. ..... 229/41 B; 206/167; 229/27

[51] Int. Cl.[2] ..... B65D 5/10; B65D 5/48

[58] Field of Search ..... 229/23 BT, 27, 28, 39, 229/41 B; 206/167

[56] References Cited

UNITED STATES PATENTS

| | | | |
|---|---|---|---|
| 1,985,779 | 12/1934 | Himes | 229/32 X |
| 2,880,921 | 4/1959 | Persson | 229/28 |
| 2,898,029 | 8/1959 | Sherman | 229/41 B |
| 2,914,237 | 11/1959 | Malmad | 229/41 B |
| 3,195,797 | 7/1965 | De Feo | 229/27 |
| 3,283,950 | 11/1966 | Bolding | 206/167 X |
| 3,790,064 | 2/1974 | Kramer | 229/41 B X |
| 3,836,065 | 9/1974 | Hackenberg | 229/41 B X |

FOREIGN PATENTS OR APPLICATIONS

| | | | |
|---|---|---|---|
| 859,905 | 1/1961 | United Kingdom | 229/41 B |

*Primary Examiner*—Davis T. Moorhead
*Attorney, Agent, or Firm*—McDougall, Hersh & Scott

[57] ABSTRACT

Carton constructions formed from corrugated blanks are disclosed. The automatic setup cartons are formed from blanks having side panels from which top and bottom panels extend on either side thereof. Tabs and slots, if provided, lock the carton in the assembled condition and are carried on the bottom panels which are folded and glued in a manner so as to provide the automatic setup feature.

10 Claims, 12 Drawing Figures

AUTOMATIC SETUP CARTON CONSTRUCTIONS

BACKGROUND OF THE INVENTION

This invention relates to carton constructions and in particular to carton constructions formed from corrugated cardboard blanks. The invention is particularly applicable to cartons of various sizes referred to in the trade as regular slotted cartons (RSC) and variations thereof. Such cartons are employed for packing and handling of goods and are produced from blanks which are cut into specified sizes and then folded into a flat configuration for storage and shipment.

In conventional RSC type cartons, prior to using it is necessary to manually assemble the carton. Such assembly includes the steps of opening the carton so as to form a rectangular configuration from the side panels, closing the bottom panels via stapling, tape or glue and finally loading the carton and sealing the top panels by a similar procedure. As will be appreciated, these steps require a good deal of manual labor and substantially increase the labor costs in such industries as fruit and vegetable packing, industrial shipment of material and supplies, and various other environments.

Accordingly, there has been a long-felt need to provide a corrugated carton construction which reduces the amount of manual labor required in order to assemble and load a carton. One method of accomplishing this reduction in setup time is to provide carton blanks that automatically set up and lock themselves into usable condition when the side panels are first separated to form the rectangular configuration. Such a construction is referred to in this specification as an "automatic setup carton". Examples of automatic setup cartons are disclosed in copending U.S. Pat. applications Ser. Nos. 299,375 and 454,356 assigned to the present assignee. So much of those descriptions as are necessary to an understanding of the present invention are incorporated herein by reference.

In addition to the above reference specifications, it has been known in the particle board industry to utilize automatic setup constructions for small non-corrugated boxes such as candy boxes, shoe boxes, hat boxes and the like. It has heretofore, been impractical, excessively expensive and technically unsatisfactory to produce an automatic setup construction for large corrugated containers.

It is accordingly an object of the present invention to produce corrugated containers of the automatic setup type.

It is another object of the invention to provide automatic setup cartons with locking means.

It is another object of the invention to provide a tab and slot arrangement for the automatic setup cartons to lock them in the setup position for loading and transporting.

It is a further object of the invention to provide an automatic setup carton having a partitioning feature permitting the carton to be divided into a number of isolated cells.

It is still another object of the invention to provide a pair of automatic setup cartons which can fit one over the other to provide an assembled container formed and closed without any manual setup and sealing.

Other objects and advantages of the invention will be apparent from the concluding portion of the specification.

DETAILED DESCRIPTION

Referring to FIGS. 1-5 an automatic setup carton construction according to a first embodiment is illustrated. The carton is formed from a blank 10 illustrated in FIG. 1 which may be cut from stock corrugated cardboard. The weight of the paper stock will depend upon the bursting strength and various other application requirements of the end user. For example, the paper stock may be treated to obtain moisture resistance, fire resistance or other qualities. The blank is cut on machines known in the art employing various die cutting devices, and if desired, various printing operations may be performed on the blank. The blank 10 has four centrally located side panels 12–15. Attached to side panel 12 is a small rectangular flap 16 which is often referred to in the trade as the manufacturer's flap. In the assembled condition, the manufacturer's flap is glued to the far side panel 15 to form a rectangular container body. Attached to one side of the side panels are top panels 17–20, while on the other side of the side panels are the bottom panels 21–24.

Figure 1:
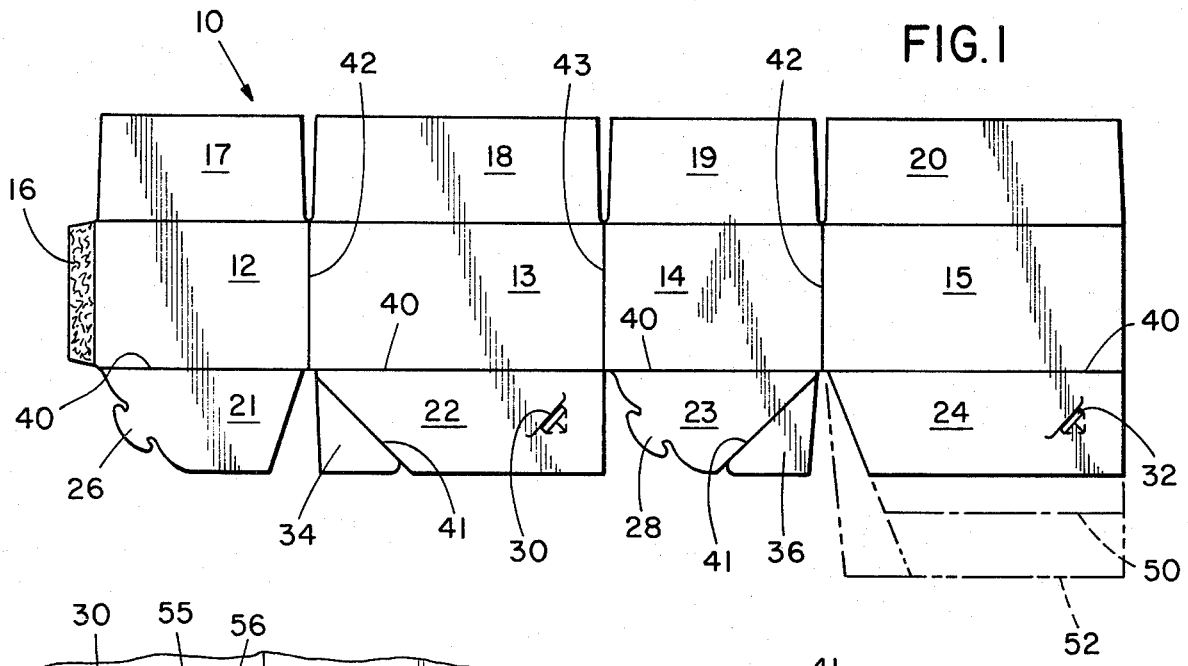
FIG. 1 is a plan view of a carton blank according to a first embodiment of the invention including locking tabs on the bottom panels.

As indicated in FIG. 1, various portions of the panels are cut out and score lines are present to define the beginning and end of each side panel. The principal features of the present invention reside in the configuration and method of adhering the various bottom panels 21–24 during assembly. In the first embodiment locking tabs 26 and 28 are provided on the bottom panels 21 and 23. These tabs in the assembled relation enter into and lockingly engage corresponding slots 30, 32 on bottom panels 22, 24. Formed on a portion of bottom panels 22, 24 are glue flaps 34, 36. As will be explained, during the construction of the carton, these flaps are reversely folded from the balance of the bottom panel so that they contact the adjoining bottom panels to which adhesive is applied.

The assembly of the blank 10 can be accomplished manually in a factory or by use of high speed machinery which is capable of performing the necessary folding and glueing steps. One such device which is capable of processing blanks for automatic setup cartons of the present invention is disclosed in copending U.S. application Ser. No. 505,451 assigned to the present assignee.

Whether accomplished by hand or by machine, the blank 10 is preferably assembled in the following sequence: The bottom panels 21–24 are folded along score lines 40 over onto the slide panels from which they depend. After the bottom panels are folded onto the side panels or, simultaneously therewith, the glue flaps 34, 36 are reversely folded along the score lines 41. Thus the bottom panels are resting on the side panels while the glue flaps are resting on the bottom panels in a sandwich fashion. This assembly sequence is illustrated in the above-referenced application Ser. No. 299,375, and reference is made thereto should further assembly clarification be desired.

After the bottom panels and the glue flaps have been folded, as described above, adhesive is applied to the manufacturer's flap 16 and to predetermined portions of panels 21 and 24. The side panels 12–15 are then folded along the score lines 42 such that the side panels 12 and 15 are folded on top of panels 13 and 14. The manufacturer's flap 16 will come into contact with the end of the side flap 15 and be adhesively secured thereto. Similarly, the reversely folded glue flaps 34 and 36 will be adhered to the selected portions of panels 21 and 24 having adhesive thereon.

After the glue has been applied and the blank folded, it is necessary to maintain the blank in this position for a time sufficient to permit the glue to cure. Desirably, a fast setting adhesive, such as hot melt glue, is utilized. After the glue has adhered, the manufacturer's flap will join the side panels together while the glue flaps 34, 36 will permanently adhere the bottom panels together.

The resulting structure is maintained in a flat or collapsed condition until it is desired to utilize the carton. In this manner, several such cartons can be efficiently stacked and shipped to the point of use. When it is desired to set up one of the cartons produced in this manner, it is merely necessary to apply pressure to the side panels causing the various side panels to each assume one side of the rectangular configuration illustrated in FIGS. 3–5. As the carton goes from the flat position to the rectangular shape, the glue flaps 34, 36 secured to the panels 21, 24 are effective for pulling all of the bottom panels down from their folded condition inside the side panels so that they appear as illustrated in FIG. 4.

Figure 3:
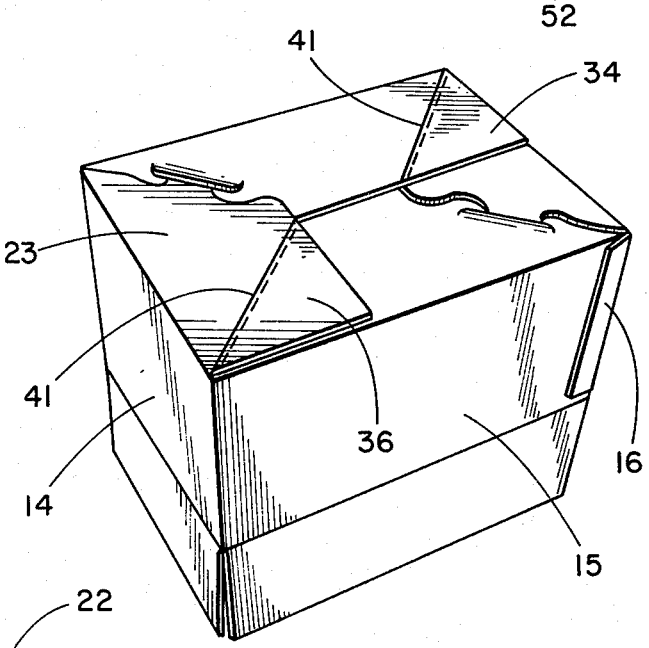
FIG. 3 is a bottom perspective view illustrating the blank of FIG. 1 in an intermediate condition just prior to the tabs locking in the slots.
Figure 4:
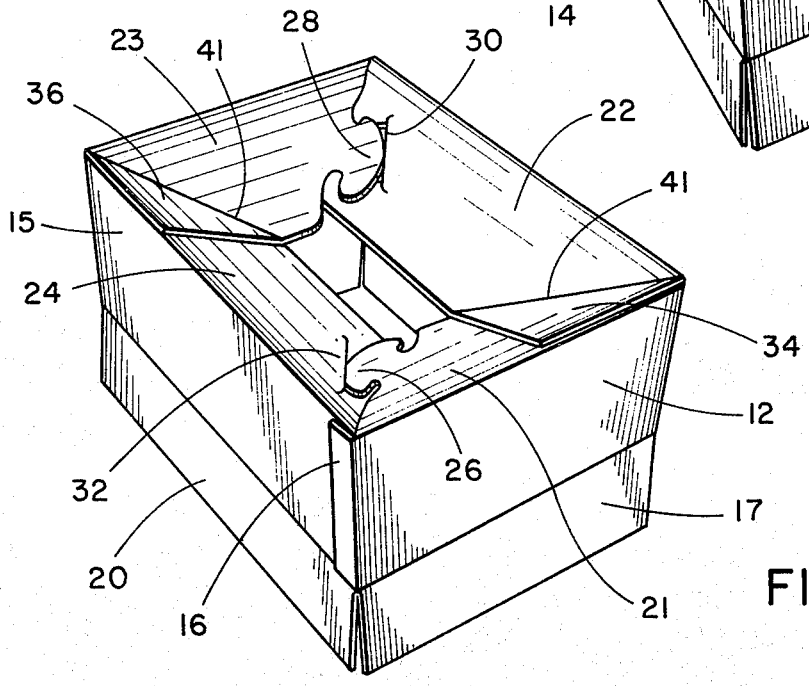
FIG. 4 is a bottom perspective of the FIG. 1 blank in its assembled, locked condition.
Figure 5:
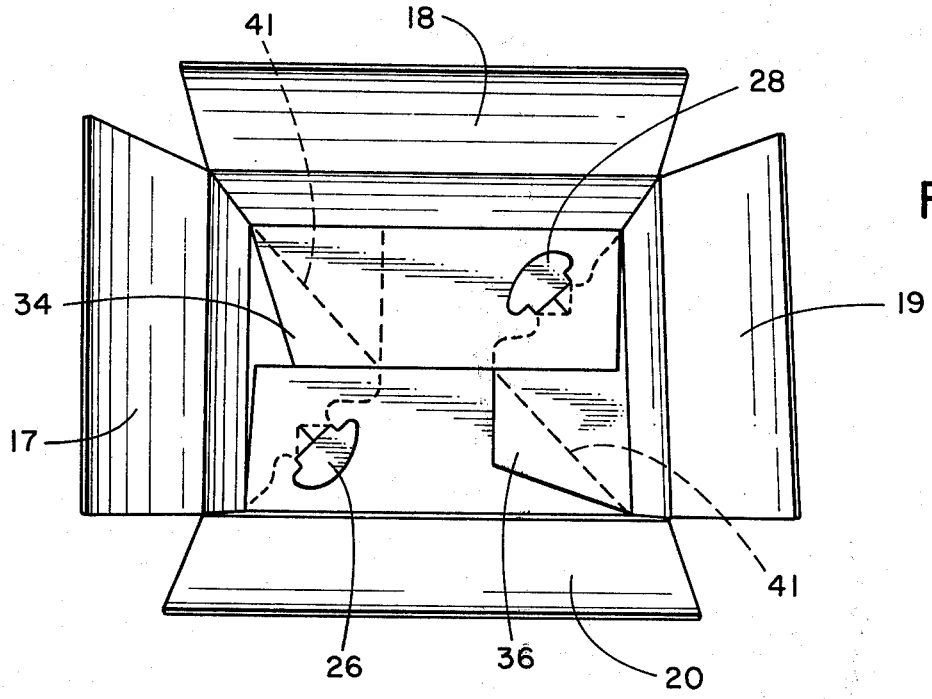
FIG. 5 is a top perspective showing the detail of the assembled carton.

In the case of the first embodiment wherein locking tabs 26 and 28 are utilized, the tabs will begin to engage the corresponding slots 30, 32 as the carton assumes its final shape (FIG. 3). The tabs readily enter the slots but once fully passed therethrough become secured and will not slip out. Thus, as the carton is assembled, the bottom panels will assume the flat configuration illustrated in FIG. 4 as the tabs pass into the slots. Once the tabs are locked in the slots the bottom panels are maintained in a flat position and the carton is ready for use. The bottom is as secure and strong as if it had been taped, stapled or otherwise secured using prior manual techniques. FIG. 5 illustrates the interior arrangement of the box and in dashed lines indicates the various structures in their final position in the assembled carton.

Referring again to FIG. 1, it is noted that bottom panel 24 is the panel which extends across the interior of the bottom of the carton in its assembled condition. As indicated, the flap 24 can be extended to the length indicated by dashed line 50 or to dashed line 52. A flap extended to the dashed line 50 will create a partial overlap of the flap 24 on the flap 22 when the carton is assembled. For certain purposes this partial overlap is highly desirable. For example, this partial overlap acts to reduce the possibility of outside contaminants entering the carton where the flaps come together. This reduces entry of vermin, dirt and the like. Similarly, by extending the flap 24 to the dimensions indicated by dashed lines 52, a full overlap of the construction is obtained. Such an arrangement not only provides the sealing obtained with the partial overlap but further provides additional bottom strength for the carton due to the double layer of corrugated material. It should be noted that for the remaining embodiments of this specification, it is similarly possible to provide partial or full overlapping bottom panels to obtain the same kind of advantages here described.

Figure 2:
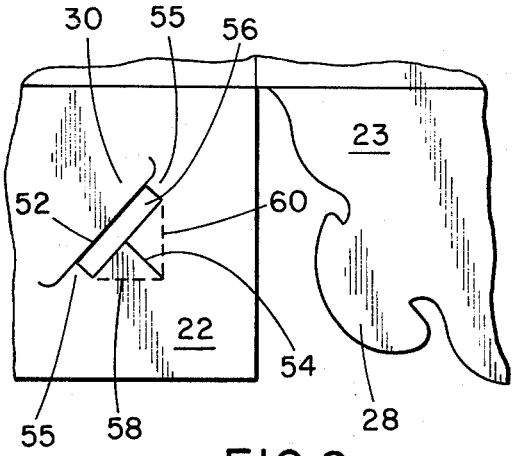
FIG. 2 is an enlarged view of the locking tab and slot structure of the blank illustrated in FIG. 1.

Referring now to FIG. 2, an enlarged view of the slot and tab arrangement is illustrated. The tabs are preferably of a mushroom shape and extend from the bottom panels 21 and 23. It will be apparent that various other tab shapes could be utilized for the present purpose. A slot 30 is adapted to receive the tab 28, formed by die cutting the bottom panels in the following manner. Die cuts 52 and 54 are made in the blank at the time that the blank is cut from the corrugated stock. Similarly, a rectangularly shaped slot 56 is cut out by completely severing all of the corrugated material. Finally, the panels are scored along the dotted lines 58 and 60.

The slot 30 as thus constituted is adapted to receive a tab therein. The tab initially enters the rectangular slot 56 and, as the carton assumes its rectangular shape, the tab pushes downwardly on the panel 22 pushing under the score line 52. Once the tab has entered to the point where it constricts in dimension, the tab is engaged or locked in the slot by the corners 55 of the bottom panel.

The knife cut 54 and the score lines 58 and 60 accommodate slight misalignment between the tab and the slot by permitting the tab to depress these areas along the knife cut and score lines. Entry of the tab into the rectangular slot 56 is thus insured. Once in the slot 56, locking engagement when the carton is set up is automatic and highly reliable.

In summary, as thus far described, an automatic setup carton blank has been described which can be prepared on high speed automated equipment. The blank utilizes an interconnected bottom panel arrangement having glue flaps connecting the panels and tabs and slots thereon such that when the cartons are set up by pressure on the side panels the tabs enter and lock in the slots, maintaining the carton in its assembled and ready-to-use condition without any further attention to the sealing or securing of the bottom panels. After the carton has been loaded, it is only necessary to manually seal the top panels in the ordinary manner.

Figure 6:
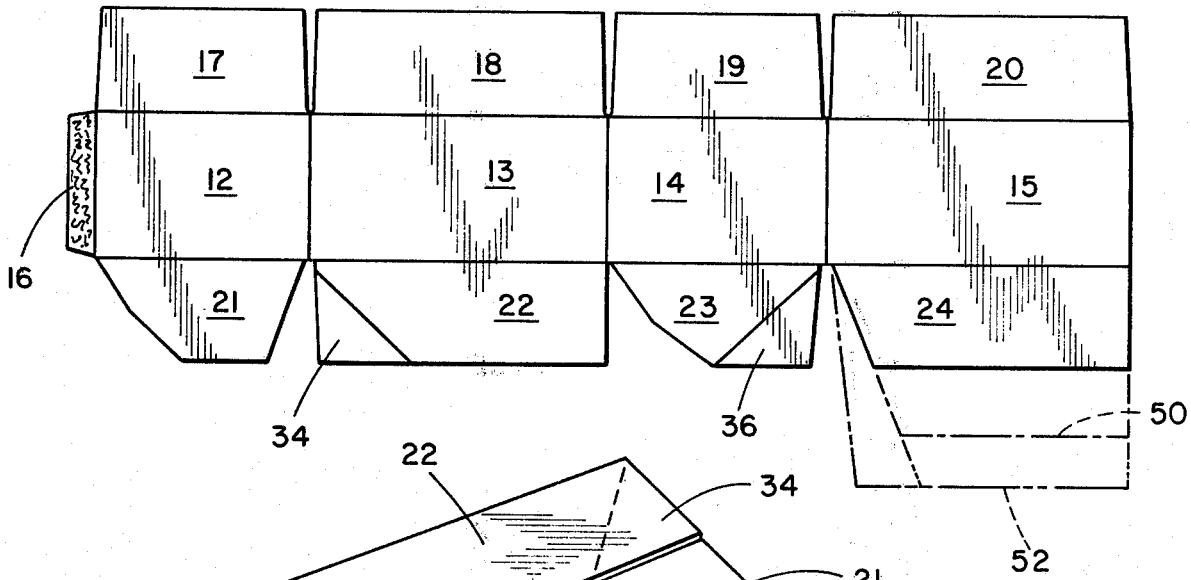
FIG. 6 is a plan view of a blank according to a second embodiment of the invention wherein locking tabs are not utilized.
Figure 7:
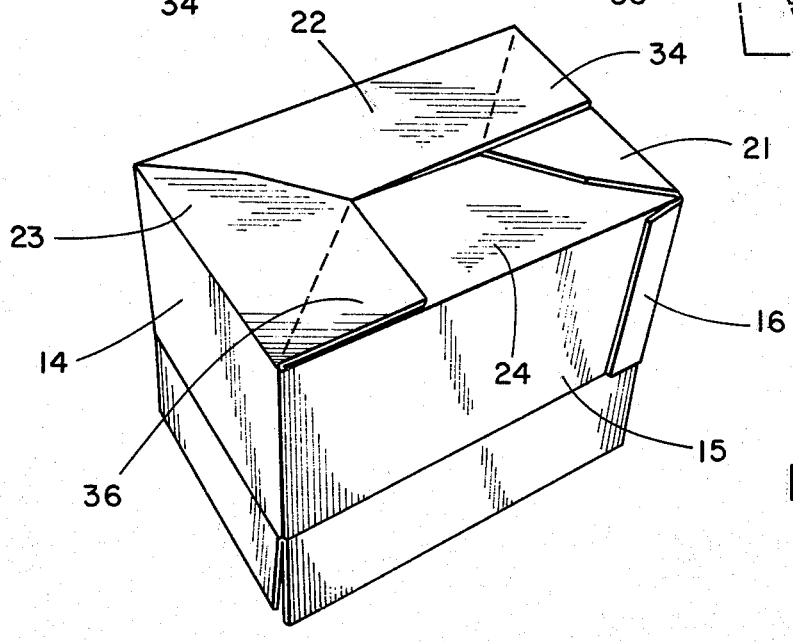
FIG. 7 is a bottom plan view of the assembled blank of FIG. 6.
Figure 8:
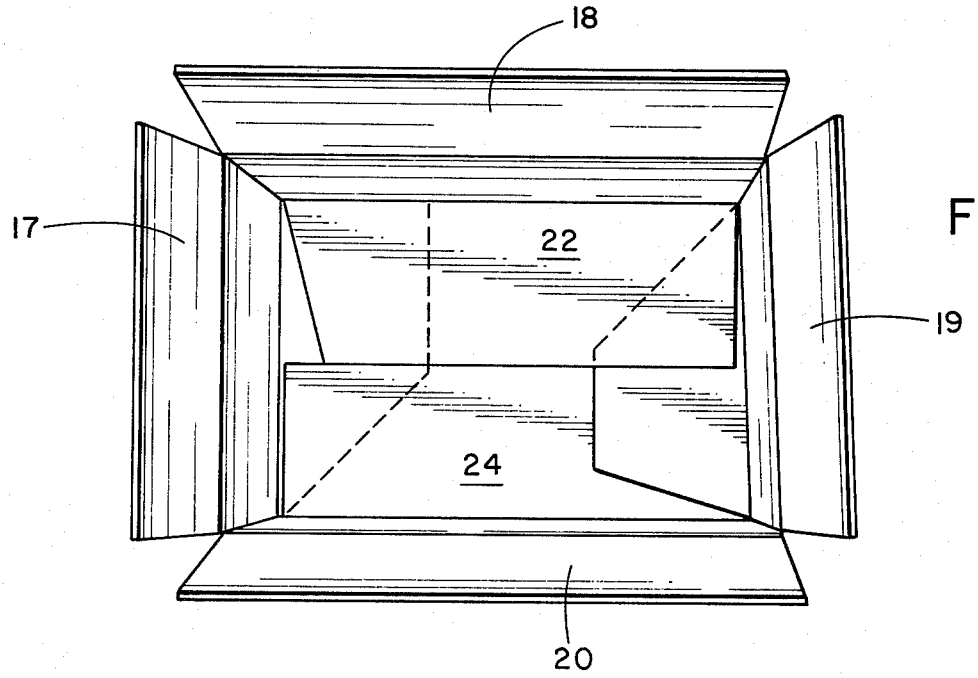
FIG. 8 is a top perspective view of the assembled blank of FIG. 6.

Referring now to FIGS. 6—8, an automatic setup carbon is disclosed according to a modification of the invention whereby the locking tabs and slots are omitted. In all other respects, this embodiment corresponds to the construction illustrated in FIG. 1 and accordingly, identical numbers have been used to designate similar parts. Use of the FIG. 6 blank without the locking tab and slot arrangement is desirable where it is not necessary that the carton be absolutely locked prior to loading. Omission of the tabs and slots reduces the number of steps required to produce the blank and accordingly lowers the unit cost.

Without the tab and locking slot arrangement, when the carton is pressed to push the side panels into a rectangular configuration, the carton will assume a position substantially fully open. It may sometimes be necessary to reach inside the carton through the top and press the bottom flap 24 downwardly to fully erect the carton. However, as soon as material is loaded into the carton, the carton is stabilized and will not return to its folded condition.

As with the FIG. 1 embodiment, the bottom panel 24 can be of various lengths to permit a partial overlap as indicated by dashed line 50 or a full overlap as indicated by dashed line 52 to obtain a sealing relationship and, if necessary, additional bottom strength. As will be apparent with both constructions, the size of the glue flaps 34 and 36 and the configuration of the bottom panels 21–24 may be varied as desired to provide additional glue area to obtain greater strength or for special requirements or to effect an open or completely sealed bottom where these are desirable. For example, in the case of boxes utilized for shipping fruit, ventilation is required by law. This can be accomplished by slots in the side panels and by providing a foreshortened flap 24 which does not meet the corresponding flad 22 in the assembled condition.

Figure 9:
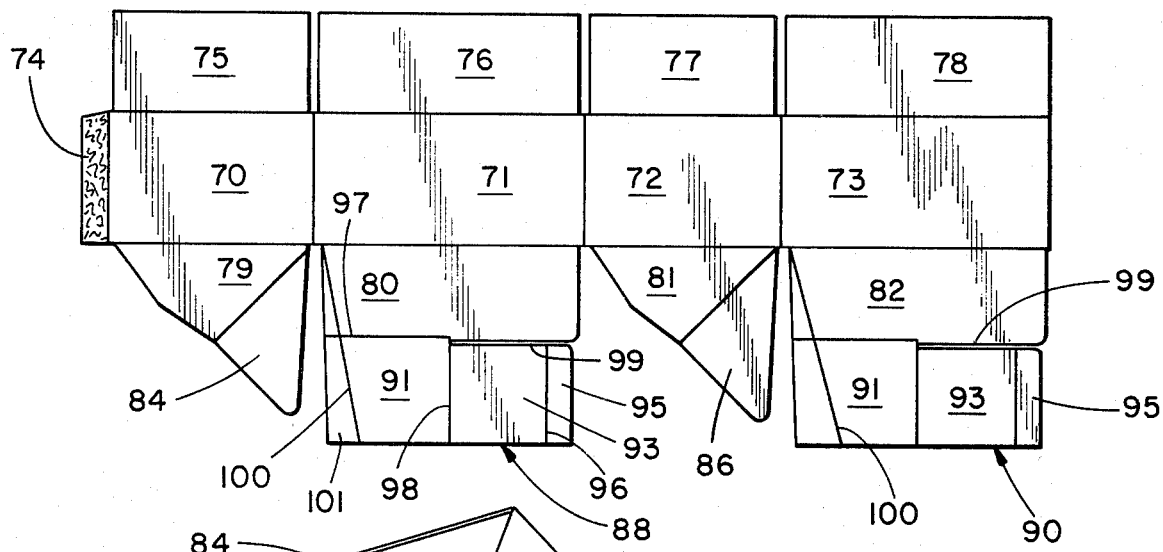
FIG. 9 is a plan view of a blank according to a third embodiment of the invention having partition flaps extending from the bottom panels of the blank.
Figure 10:
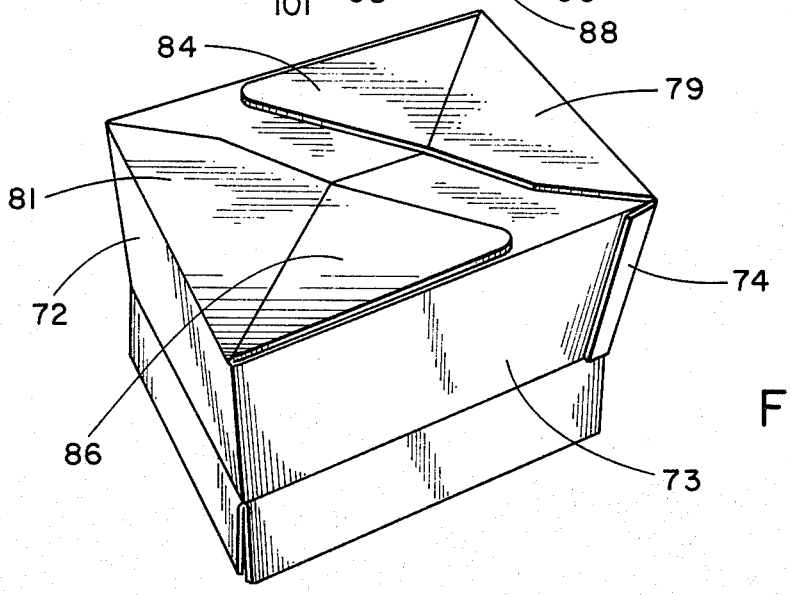
FIG. 10 is a bottom perspective view of the partition blank in its assembled condition.
Figure 11:
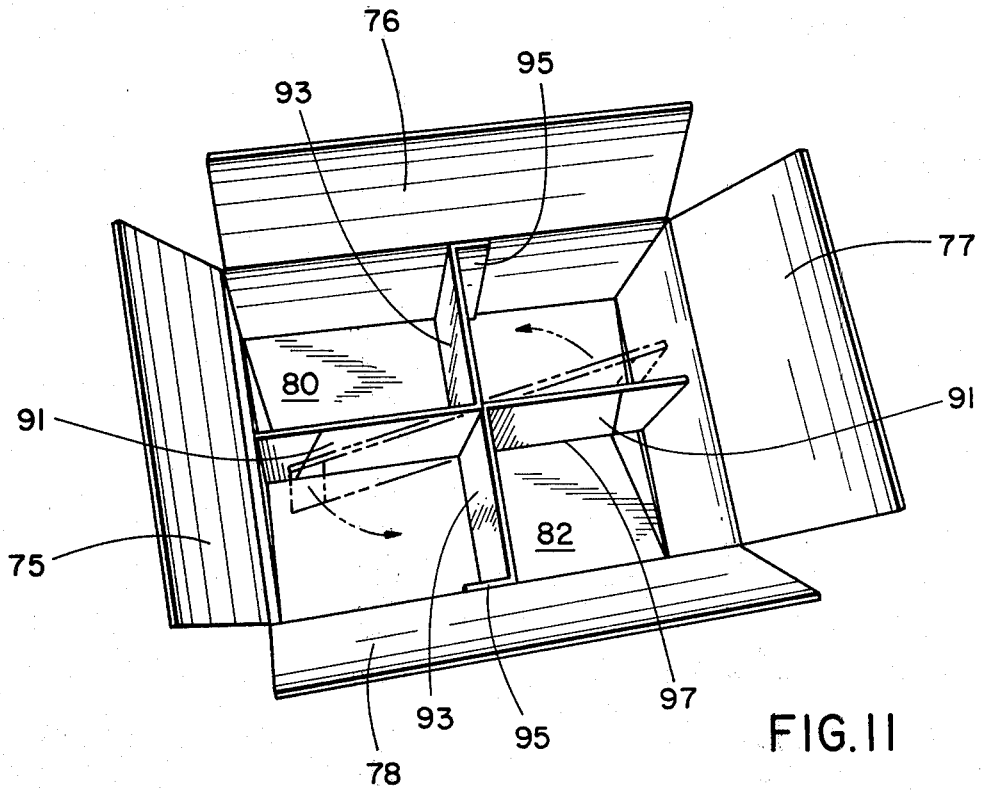
FIG. 11 illustrates the partition blank in its assembled condition with the partitions deployed to create individual packing cells.

Referring now to FIGS. 9–11, a third embodiment of the automatic setup carton is disclosed. This construction produces an automatic setup carton in a flat condition for storing and which, when assembled, automatically sets up its bottom and has partitions attached to certain of the bottom flaps for forming a partitioned carton having a plurality of cells therein. Such a partitioned carton is especially useful for packing fragile items such as glass, china and the like, which must be maintained separately so that there is no shifting of the contents against each other. The blank from which the partitioned carton is formed is illustrated in FIG. 9. This blank has side panels 70–73, the side panels being defined by crease lines in substantially the same manner as the blanks of FIGS. 1 and 6. A manufacturer's flap 74 is provided on the end of side panel 70. Connected to one side of the side panels are top panels 75–78. Connected on the opposite side are the bottom panels 79–82. Bottom panels 79 and 81 carry glue flaps 84 and 86 thereon which flaps are reversely folded during the carton forming process into a flat assembly such that glue applied to the flaps 80 and 82 is effective for securing flaps 84 and 86 thereto in the manner indicated for the previous embodiments. Due to the nature of this particular construction, glue flaps 84 and 86 are slightly enlarged to provide a larger area of attachment. This adds stability and extra strength to the bottom panels.

Formed on the ends of the bottom panels 80 and 82 are the partition assemblies 88 and 90. The partitions are extensions of the bottom panels and have a plurality of crease lines to permit positioning of the partitions once the carton is assembled. The partition assemblies 88 and 90 include a stationary flap 91 and a swingable flap 93. The flap 93 has a further portion 95 defined by crease line 96. Flap 91 is defined on the bottom panel 80 by crease line 97 while the swingable flap 93 is defined by crease line 98 and cut 99. Passing transversely across the bottom panels 80 and 82 is crease line 100 which is provided to permit upward bending of the triangular portion 101 in the assembled condition. This bending is necessary due to the excessive length of the bottom panel and partitions.

The assembly of the blank illustrated in FIG. 9 is accomplished in the same manner as shown and described for the preceding embodiments. The bottom panels 79–82 including the glue flaps and the partitions are folded over onto the side panels 70–73 respectively. The side panels are then folded so as to form a flat carton. Glue applied to the bottom panels 80 and 82 secures the reversely folded glue flaps thereto. To set up the carton, pressure is exerted on the flat carton construction, in order to form a rectangular shaped container. The result is as indicated in FIGS. 10 and 11.

Referring to FIG. 11, the carton when set up pulls the bottom panels 80, 82 downwardly due to their being connected by the glue flaps 84, 86 to the bottom panels 79, 81. As this occurs, the partitions 88 and 90 are bent along the fold line 97 so as to extend vertically upward along the middle of the carton. In order to deploy the partitions to form a four-celled carton, it is only necessary to rotate the movable flaps 93 in the directions indicated by the arrows. As each of the partitions is so rotated, the movable flap 93 contacts the side wall of the carton. The portion 95 of flap 93 bends along its crease line 96 to wedge against the side wall to retain the movable flap 93 in a position perpendicular to the stationary flap 91. Thus, as shown in solid lines, after the rotation of the movable flap, a four-celled partition carton is formed. The carton may then be filled with merchandise and its top panel sealed in the usual manner. If desired, one or both movable flaps can be maintained in the unfolded position to generate a two- or three-celled configuration.

Figure 12:
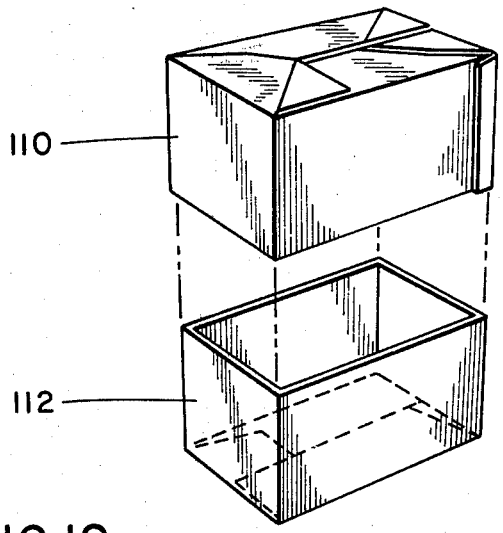
FIG. 12 illustrates a modified form of the present invention wherein two blanks, one of a slightly larger dimension, are employed to fit one over the other; top panels are omitted from this construction.

Referring now to FIG. 12, a final embodiment of the present invention is illustrated. In this embodiment a construction is formed from a blank identical to the blanks illustrated in FIGS. 1 and 6, excepting, however, that no top panels are provided. Desirably one of the carton constructions 110 is of a slightly larger dimension both in its length and width than a lower carton construction 112. As indicated in FIG. 12, this difference in dimension and the omission of top flaps permits the inversion of the upper carton 110 so that it will fit over and seal the lower carton 112. This combination of two automatic setup cartons achieves total automatic setup of a container. In this manner, the lower carton 112 may be filled with merchandise such as fruit or other goods by a field worker and then the larger carton 110 may be inverted and placed over the lower carton to completely close the container. Thus, absolutely no manual sealing of the container is required and the need for tape, staples or other closure devices is eliminated. Cartons 110 and 112 can be provided with or without locking tabs, as desired. Further, it will be appreciated that these cartons can have various amounts of overlap of their bottom panels to provide necessary strength for a given usage.

While we have shown and described embodiments of this invention in some detail, it will be understood that this description and the accompanying illustrations are offered merely by way of example, and that the invention is to be limited in scope only by the appended claims.

We claim:

1. An automatic setup carton formed from a precut corregated paper blank comprising a. four side panels including two outer panels and two inner panels disposed on said blank defined by score lines between adjacent panels, b. four bottom panels each extending downwardly from one of said side panels and defined by a score line therebetween, and c. glue flaps defined by score lines on the two bottom panels extending downwardly from said inner panels to adhesively secure the remaining bottom panels thereto, one of said inner bottom panels and one of said outer bottom panels being secured in over and under relationship wherein one end thereof is over one of the adjacent panels while the other end thereof is under the other adjacent bottom panel, said carton being maintained in a flat condition prior to setup with the bottom panels folded onto the side panels and upon setup the side panels are spread apart to form a rectangular configuration causing the interconnected bottom panels to automatically deploy in said over and under relationship to form the bottom of said carton.

2. The carton of claim 1 wherein one of said bottom panels is larger than the others to form an overlapping bottom.

3. The carton of claim 1 further including four top panels each extending upwardly from one of said side panels and defined by a score line therebetween.

4. The carton of claim 1 further including locking means on said bottom panels actuated during setup for securing said carton in the setup condition.

5. The carton according to claim 4 wherein said locking means comprise:

a. tabs on two of said four bottom panels; and b. locking slots on the remaining two bottom panels aligned whereby on setup each tab passes into one of said slots and is retained therein.

6. The carton of claim 1 further including partition means extending from two of said bottom panels for dividing the interior of said carton into at least two separate cells.

7. The carton according to claim 6 wherein said partition means includes:

a. a stationary flap defined by a score line between said bottom panel and said flap; and b. a movable flap attached to said stationary flap and defined by a score line therebetween, said stationary and movable flaps being deployed inside said carton during setup to form said separate cells.

8. The carton according to claim 7 wherein said movable flap has a further portion for engaging a side panel of said carton whereby rotation of one or both of said movable flaps to a position perpendicular to said stationary flaps forms a three- or four-celled carton, respectively, said further portion serving to secure said movable flap in the perpendicular position.

9. The carton according to claim 4 further including partition means extending from two of said bottom panels for dividing the interior of said carton into at least two separate cells.

10. The carton of claim 1 wherein a second automatic setup carton of slightly larger dimensions is employed to seal the open top of the first carton thereby to provide a sealed container formed without manual sealing.

* * * * *

Disclaimer and Dedication 3,960,313.—*Alan M. Sax*, Chicago, and *Walter J. Stolkin*, Schaumburg, Ill. AUTOMATIC SETUP CARTON CONSTRUCTIONS. Patent dated June 1, 1976. Disclaimer and Dedication filed May 14, 1982, by the assignee, *Stone Container Corp.*

Hereby disclaims and dedicates to the Public the entire remaining term of said patent.

[*Official Gazette July 6, 1982.*]